United States Patent [19]

Hunter

[11] 4,292,912

[45] Oct. 6, 1981

[54] TRANSFER AND DOCKING APPARATUS FOR USE ON VARIABLE DRAFT MARINE VESSELS

[75] Inventor: Andrew F. Hunter, Houston, Tex.

[73] Assignee: Conoco, Inc., Ponca City, Okla.

[21] Appl. No.: 43,718

[22] Filed: May 30, 1979

[51] Int. Cl.[3] ..... B63B 59/02

[52] U.S. Cl. ..... 114/219; 9/1.6; 405/212

[58] Field of Search ..... 182/82, 83, 84, 85, 182/86; 405/212, 215, 221; 9/1.6, 1.7; 114/219, 230, 56

[56] References Cited

U.S. PATENT DOCUMENTS

| | | | |
|---|---|---|---|
| 990,701 | 4/1911 | Burge | 182/83 |
| 1,343,094 | 6/1920 | Sims | 182/84 |
| 2,915,879 | 12/1959 | Besse | 405/212 |
| 3,841,439 | 10/1974 | Nilsson | 182/84 |
| 4,084,533 | 4/1978 | Boyer | 114/219 |

*Primary Examiner*—Trygve M. Blix
*Assistant Examiner*—D. W. Keen
*Attorney, Agent, or Firm*—A. Joe Reinert

[57] ABSTRACT

A transfer and docking apparatus for use on variable draft marine vessels. A plurality of parallel sloping fenders extend from above the maximum draft level of the vessel to below the minimum draft level of the vessel. A stairway is provided adjacent and parallel to at least one of the fenders and is mounted inboard of the fender.

14 Claims, 7 Drawing Figures

TRANSFER AND DOCKING APPARATUS FOR USE ON VARIABLE DRAFT MARINE VESSELS

BACKGROUND OF THE INVENTION

1. Field of the Invention

The present invention relates in general to apparatus for docking marine vessels alongside other marine vessels or structures and for transferring personnel or equipment between the vessels and structures, and more particularly, to such apparatus for use on vessels and structures having a variable draft.

2. Description of the Prior Art

In the past, many apparatus and methods have been devised for docking vessels at sea and for transferring personnel and equipment between them. This docking and transfer is particularly a problem where one or both of the vessels has a variable draft or where wave action causes the vessels to move with respect to each other. Incidentally, as used herein, the term "draft" means the level of water with respect to the vessel. Also, the term "vessel" as used herein is defined broadly so as to include marine structures. One problem presented by variable draft is that it prevents a single level stationary platform on one vessel from meeting and engaging a single level stationary platform on the other vessel. This problem led to the development of multiple level platforms or ladders allowing transfer at various levels depending on the present draft condition. This, however, proved to be unsafe since a ladder or platform which is frequently submerged becomes coated with algae and the like and is consequently very slippery. This problem is, of course, accentuated when wave action or wind makes climbing a ladder or standing on a platform difficult even without algae.

Another way of meeting the problem of variable draft is to move a platform or stairway up or down to adjust for the variation in draft. Apparatus to achieve this type of result are shown in U.S. Pat. Nos. 3,841,439 and 4,115,887. In these patents a platform along the side of a vessel is raised and lowered by cables attached to a winch. A first ladder is joined to the side of the platform and extends to the deck to allow persons to move between the deck and the platform. The slope of the first ladder varies with the adjustment of the platform. A second ladder extends down from the platform to the docking ship. In U.S. Pat. No. 4,115,887, a turning weight urges the platform against the ship's side to make the platform more steady during wave action. As indicated by the necessity of the turning weight just described, the devices shown in these patents are subject to undesirable movement since their lower ends may not be attached to the ship. Another disadvantage of these devices is the requirement of an operator for the winches. This operator must be located in such a position that he can see both the platform and the docking vessel during operation of the platform. It is also to be noted that these devices do not have a bumper system to fend the docking vessel from the vessel to which the platform is attached.

In U.S. Pat. No. 3,426,542 a dock and ladder system is shown in which a fendering dock assembly is moved up and down by suspending cables. This allows adjustment for the variable draft created by tides on a marine structure such as an offshore drilling platform. This device also suffers from the requirement of an operator. Furthermore, it is a complicated and expensive device.

Several different fender devices have been developed for use on offshore structures or vessels such as drilling platforms and storage vessels. Usually these fender devices provide a solid fender which is flexibly attached to the vessel. Such fenders are shown in U.S. Pat. Nos. 3,564,858; 3,675,610, and 3,901,040. A disadvantage of each of these fender devices is that they do not provide a safe means for transferring personnel and equipment from the docked boat.

It is accordingly an object of the present invention to provide an improved boarding and fender apparatus for use on variable draft vessels.

It is also an object of the present invention to provide such a boarding and fender apparatus having improved safety features.

Yet another object of the present invention is to provide such a boarding and fender apparatus which is both simple and economical.

SUMMARY OF THE INVENTION

Accordingly, the boarding and fender apparatus of the present invention has a plurality of parallel sloping fenders which are attached to a vessel. Mounted adjacent and parallel to at least one fender is a means for ascending and descending such as stairs. These stairs are located inboard of the fender. The stairs and fenders extend from below the minimum draft level of the vessel to above the maximum draft level of the vessel.

For a further understanding of the invention and further objects, features and advantages thereof, reference may now be had to the following description taken in conjunction with the accompanying drawings.

DESCRIPTION OF PREFERRED EMBODIMENTS

Figure 1:
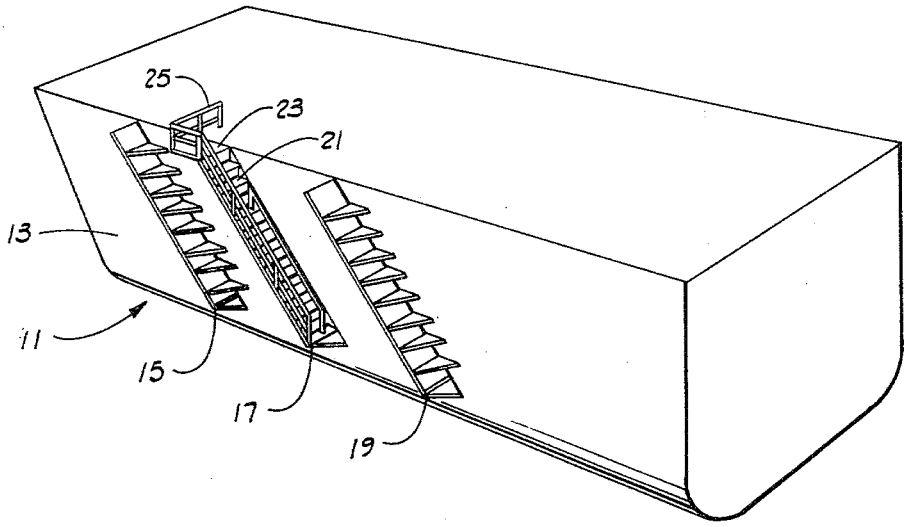
FIG. 1 is a perspective view of the present invention mounted on a vessel.

Referring now to FIG. 1, the boarding and fender apparatus of the present invention denoted generally by reference numeral 11 is shown attached to a vessel 13. As used herein the term "vessel" is defined broadly to include any marine structure where docking and transfer are desired. Thus, while vessel 13 in FIG. 1 is shown generally in the form of a storage barge, it could be an offshore drilling platform or the like. Apparatus 11 is comprised of three fender members 15, 17 and 19. These members extend diagonally down the side of vessel 13 and are generally parallel to each other. The slope of members 15, 17 and 19 with respect to the vertical is approximately 45°. The central fender member 17 has stairs 21 to allow ascending and descending. At the top of the stairs 21 is a platform 23 protected by a guard rail 25. Platform 23 is level with the deck of vessel 13.

Figure 2:
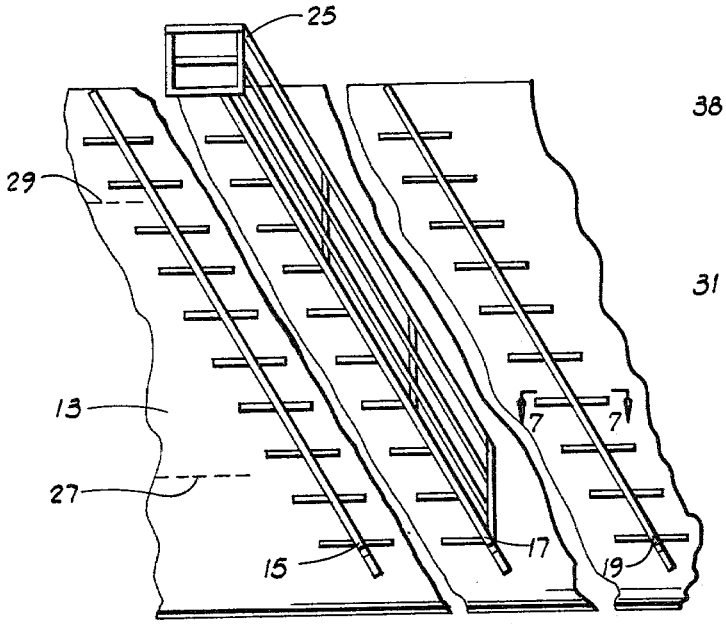
FIG. 2 is a side elevational view of the invention shown in FIG. 1.

Referring now to FIG. 2, the parallel and sloping nature of members 15, 17 and 19 is more easily apparent. Vessel 13, to which members 15, 17 and 19 are attached, has a minimum draft level 27 and a maximum draft level 29. Thus, depending on the load in vessel 13 (or the tide on a fixed vessel), the level of the water will vary between draft level 27 and draft level 29. Members 15, 17 and 19 each extend from below level 27 to above level 29. Preferably the wind and wave direction is from left to right as seen in FIG. 2. This helps reduce the resistance created by the members.

Figure 3:
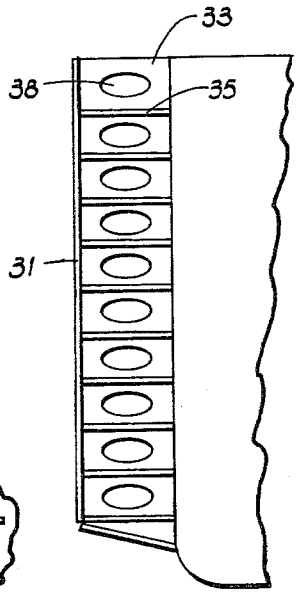
FIG. 3 is an end elevational view of the invention shown in FIG. 1.
Figure 7:
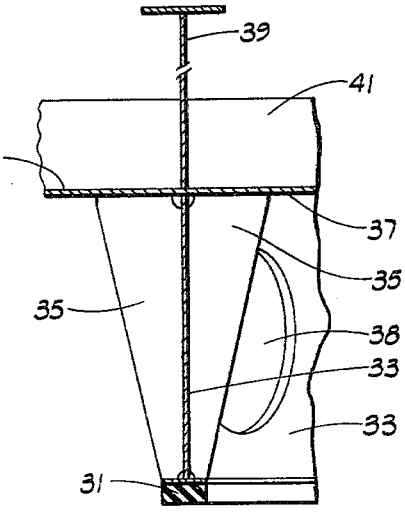
FIG. 7 is a cross-sectional view of the right fender shown in FIG. 2.

Referring now to FIGS. 3 and 7, the structure of outer member 19 (and by analogy of 15, since members 15 and 19 are constructed and function in the same way) can be seen in more detail. The outermost portion of the member 19 is a fender 31. Fender 31 is a bar of steel or the like and serves as a contact point for the docking boat. If desired a non-abrasive material such as rubber or canvas can be placed over fender 31 to prevent scarring of a docked boat. Supporting fender 31 outwardly from vessel 13 is a strut plate 33 and horizontal supports 35. Strut plate 33 extends outwardly, normal to the skin 37 of vessel 13. The inner edge of plate 33 is welded to fender 31. In spaced relation along plate 33 are the horizontal supports 35. Horizontal supports 35 also extend from skin 37 to fender 31. The inner edges of supports 35 are wider than the outer edges to allow improved support against lateral movement of fender 31. Supports 35 are welded to plate 33, skin 37 and fender 31. Between horizontal supports 35 are openings 38 in strut plate 33. Openings 38 allow water and wind to pass between fender 31 and skin 37, decreasing the resistance created by fender member 19. It is desirable to locate the horizontal supports 35 in connection with the supporting structure of vessel 13. In FIG. 7, vessel 13 is shown having a vertical girder support 39 and a horizontal girder support 41. Horizontal supports 35 are preferably located at the junction of girders 39 and 41 or, alternatively, at a location simply over girders 41.

Figure 4:
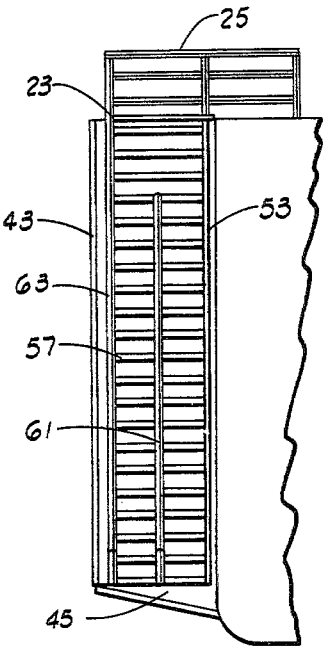
FIG. 4 is an end elevational view of the central fender and stairs of the invention shown in FIG. 1.
Figure 5:
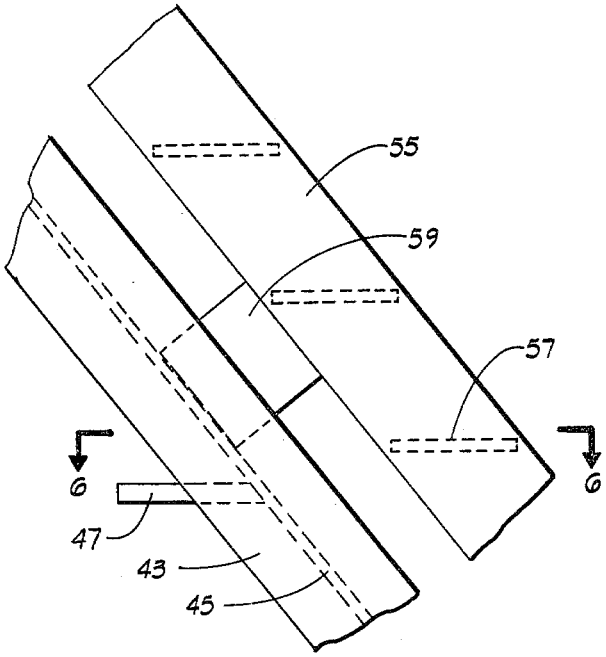
FIG. 5 is an enlarged elevational view of the central fender and stairs of the present invention.
Figure 6:
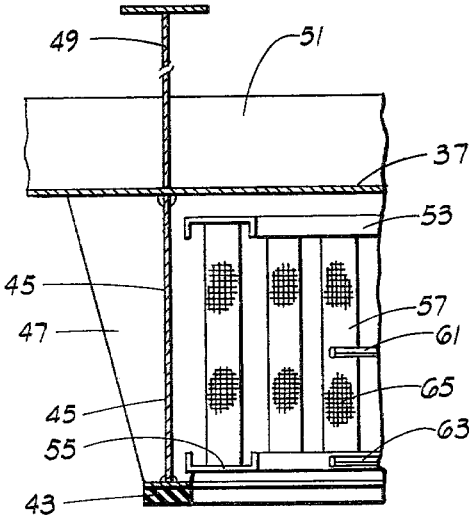
FIG. 6 is a cross-sectional view of the central fender and stairs shown in FIG. 5.

Referring now to FIGS. 4, 5 and 6, the central fender member 17 will be described in more detail. Except for the means for ascending and descending, the central fender member 17 is very similar to the other fender members 15 and 19. The outermost portion of member 17 is a fender 43. Like fender 31, fender 43 is composed of steel or the like and can be covered with a non-abrasive material such as rubber or canvas. A strut plate 45 and horizontal supports 47 position and support fender 43 outwardly from vessel 13. The inner edges of horizontal supports 47 and strut plate 45 are welded to skin 37 of vessel 13. The outer edges of horizontal supports 47 and strut plate 45 are welded to fender 43. It is preferable to locate horizontal supports 47 over a structural support of vessel 13 such as vertical girder 49 and horizontal girder 51.

Mounted on the strut plate 45 is a stairway comprised of an inner bar 53 and an outer bar 55 having steps 57 extending therebetween. This stairway is mounted on strut plate 45 such that the stairway extends adjacent and parallel to fender 43. The stairway is inboard of the fender 43 and normal to the plane formed by fenders 31 and 43 combined.

The stairway is set off from the strut plate 45 by set-off plates 59 which are welded or bolted to bars 53 and 55 and to strut plate 45. Plates 59 are located in spaced relation underneath the inner bar 53 and outer bar 55 of the stairway. The stairway is set off from strut plate 45 to help prevent accumulations of water on top of the steps 57. This set-off also facilitates cleaning of the steps to remove algae or the like.

Two handrails are provided to aid in ascending and descending the stairway. An inner handrail 63 extends upwardly along the outer edge of the stairway. These handrails can be attached either to the stairway or to the strut plate 45.

The steps 57 of the stairway which is mounted on strut plate 45 are provided with an abrasive surface 65. This abrasive surface 65 on steps 57 improves traction on the step surface to reduce the tendency to slip.

From the above description it can be seen that the docking of boats and transfer of personnel and equipment is facilitated by the apparatus of the present invention. A docking boat approaches the vessel 13 with its docking side disposed toward the fender members 15, 17 and 19. The combination of the three fender members provides a three-point (or sometimes a two-point) support which maintains the distance between vessel 13 and the docking boat. This support is provided regardless of the present draft level since the fender members are parallel to each other.

Since the stairway is located on the central fender member 17, transfer of personnel and equipment is allowed even from extreme ends of the docking boat. For example, if the personnel to be transferred are located in the aft, starboard side of a docking vessel, the docking vessel can approach the fender members 15 and 17 such that fender member 17 encounters the aft starboard side of the vessel. Fender member 15 encounters the docking vessel amidships such that the distance between the docking vessel and vessel 13 is maintained.

Once the docking vessel has docked such that the personnel to be transferred are located along fender member 17, the transfer of personnel occurs by their climbing from the docking boat onto the stairway or vice versa. In some cases it might be desirable to omit a portion or portions of the outer handrail 63 to facilitate this transfer.

If desired, an equipment moving system can also be attached adjacent and parallel to fender 43 to allow equipment to be transferred other than by carrying. Such a system could be mounted to strut plate 45 inboard of inner handrail 61.

Thus, the boarding and fender apparatus of the present invention is well adapted to attain the objects and advantages mentioned as well as those inherent therein. While presently preferred embodiments of the invention have been described for the purpose of this disclosure, numerous changes in the construction and arrangements of parts can be made by those skilled in the art, which changes are encompassed within the spirit of this invention as defined by the appended claims.

The foregoing disclosure and showings made in the drawings are merely illustrative of the principles of this invention and are not to be interpreted in a limiting sense.

The embodiments of the invention in which an exclusive property or privilege is claimed are defined as follows:

1. An improved marine vessel of the type having a variable draft, the improvement comprising:

at least two parallel sloping fenders extending from above the maximum draft level of the vessel to below the minimum draft level of the vessel so that at least two fenders separated by a predetermined fixed distance are presented to a docking vessel at any draft level of said marine vessel between said minimum draft level and said maximum draft level;

means for fixedly attaching said two fenders to the marine vessel; and means for ascending and descending mounted adjacent and parallel to at least one of said two fenders so that personnel from said docking vessel may disembark directly from said docking vessel onto said means for ascending and descending.

2. The improvement of claim 1 wherein the attaching means comprise support struts which set off said fenders from the marine vessel.

3. The improvement of claim 2 wherein the ascending and descending means comprise stairs mounted inboard of said at least one of said fenders.

4. The improvement of claim 3 wherein the ascending and descending means further comprise a handrail mounted inboard of said at least one of said fenders.

5. The improvement of claim 1 wherein the ascending and descending means comprise stairs mounted inboard of the at least one of said fenders.

6. The improvement of claim 5 wherein said stairs are mounted such that the plane of the stairs is normal to the plane of said fenders.

7. A boarding and fender apparatus for use on a variable draft vessel comprising:

at least two parallel sloping fenders;

means for ascending and descending mounted adjacent and parallel to at least one of said two fenders and inboard of said at least one of said two fenders; and means for fixedly attaching said fenders and said ascending and descending means to said variable draft vessel so that at least two fenders separated by a predetermined fixed distance are presented to a docking vessel and personnel from said docking vessel may disembark directly from said docking vessel onto said means for ascending and descending.

8. The apparatus of claim 7 wherein the ascending and descending means comprise stairs.

9. The apparatus of claim 8 wherein the ascending and descending means further comprise a handrail.

10. The apparatus of claim 9 wherein said at least one fender and said stairs extend from above a maximum draft level of the variable draft vessel to below a minimum draft level of the variable draft vessel.

11. A boarding and fender apparatus for use in transferring passengers to and from boats which reside at varying levels with respect to a marine structure, the apparatus comprising:

at least two sloping fenders;

means for ascending and descending mounted adjacent and parallel to at least one of said two fenders and inboard of said at least one of said two fenders; and means for fixedly attaching said two fenders and said ascending and descending means to said marine structure so that at least two fenders are presented to a docking boat and passengers from said docking boat may disembark directly from said docking vessel onto said means for ascending and descending.

12. The apparatus of claim 11 wherein the ascending and descending means comprise stairs.

13. The apparatus of claim 12 wherein the ascending and descending means further comprise a handrail.

14. A transfer and fender apparatus for use on a variable draft marine vessel comprising:

first, second and third parallel sloping fenders extending from above a maximum draft level of said marine vessel to below a minimum draft level of said marine vessel;

means for ascending and descending mounted adjacent and parallel to a central one of said first, second and third fenders; and means for fixedly attaching said fenders and said ascending and descending means to said marine vessel so that three fenders separated by predetermined distances are presented to a docking vessel at any draft level of said variable draft marine vessel between said minimum draft level and said maximum draft level and so that said docking vessel may engage said central fender and either of the other of said fenders thereby providing at least a two point docking support while allowing personnel from said docking vessel to disembark directly from said docking vessel onto said means for ascending and descending.

* * * * *